US009273424B2

(12) United States Patent
Lee et al.

(10) Patent No.: US 9,273,424 B2
(45) Date of Patent: Mar. 1, 2016

(54) WASHING MACHINE

(71) Applicant: LG ELECTRONICS INC., Seoul (KR)

(72) Inventors: Kyu Bum Lee, Changwon-si (KR); Young Jong Kim, Changwon-si (KR); Sang Jun Lee, Changwon-si (KR); Young Bae Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/142,566

(22) Filed: Dec. 27, 2013

(65) Prior Publication Data

US 2014/0109626 A1 Apr. 24, 2014

Related U.S. Application Data

(63) Continuation of application No. 12/753,584, filed on Apr. 2, 2010.

(30) Foreign Application Priority Data

| | | |
|---|---|---|
| Apr. 3, 2009 | (KR) | 10-2009-0029134 |
| Apr. 3, 2009 | (KR) | 10-2009-0029139 |
| Oct. 20, 2009 | (KR) | 10-2009-0099905 |
| Nov. 13, 2009 | (KR) | 10-2009-0109908 |
| Jan. 22, 2010 | (KR) | 10-2010-0006144 |

(51) Int. Cl.

| | |
|---|---|
| ***D06F 39/08*** | (2006.01) |
| ***D06F 17/04*** | (2006.01) |
| ***D06F 35/00*** | (2006.01) |

(52) U.S. Cl.

CPC ..... *D06F 17/04* (2013.01); *D06F 35/006* (2013.01); *D06F 39/08* (2013.01)

(58) Field of Classification Search

CPC ..... D06F 39/08; D06F 17/04

See application file for complete search history.

(56) References Cited

U.S. PATENT DOCUMENTS

| | | | |
|---|---|---|---|
| 6,185,774 | B1 | 2/2001 | Tubman |
| 2003/0051514 | A1 | 3/2003 | Kim et al. |
| 2010/0205753 | A1 | 8/2010 | Kim et al. |

FOREIGN PATENT DOCUMENTS

| | | | |
|---|---|---|---|
| CN | 2283662 | Y | 6/1998 |
| CN | 1285430 | A | 2/2001 |

(Continued)

OTHER PUBLICATIONS

English machine translation of KR 10-2008-0056627.*

*Primary Examiner* — Michael Barr
*Assistant Examiner* — Jason Riggleman
(74) *Attorney, Agent, or Firm* — Birch, Stewart, Kolasch & Birch, LLP

(57) ABSTRACT

A washing machine includes; a cabinet forming an external appearance and having an open upper portion; a reservoir hanging within the cabinet and allowing washing water to be put therein; a washing tub rotatably disposed within the reservoir and accommodating the laundry; and a spray nozzle spraying washing water into the washing tub such that one boundary of sprayed washing machine reaches a side wall of the washing tub and the other boundary of the sprayed washing water reaches the bottom of the washing tub, wherein the spray nozzle includes: a tube part forming a passage along which washing water is introduced; and a spray part connected with the tube part to spray washing water and disposed such that a spray face against which washing water discharged from the tube part splashes is bent at a certain angle with respect to a discharge direction of the tube part. The laundry can be effectively wet by increasing a spray range of washing water.

4 Claims, 22 Drawing Sheets

(56) References Cited

FOREIGN PATENT DOCUMENTS

| | | | | | |
|---|---|---|---|---|---|
| CN | 1285430 | A | * | 2/2001 | ..... D06F 23/06 |
| CN | 1566497 | A | | 1/2005 | |
| CN | 101285254 | A | | 10/2008 | |
| CN | 201186999 | Y | | 1/2009 | |
| EP | 1505191 | A1 | * | 2/2005 | ..... D06F 39/08 |
| EP | 1 700 943 | A1 | | 9/2006 | |
| JP | 39-011565 | | | 5/1964 | |
| JP | 55-017532 | U | | 2/1980 | |
| JP | S60-176690 | | * | 2/1984 | |
| JP | 60-176690 | A | | 9/1985 | |
| JP | 07-241399 | A | | 9/1995 | |
| JP | 9-308788 | A | | 12/1997 | |
| JP | 2001-70694 | A | | 3/2001 | |
| JP | 2002-282587 | A | | 10/2002 | |
| KR | 10-1998-0048777 | A | | 9/1998 | |
| KR | 20-0150259 | Y1 | | 7/1999 | |
| KR | 10-2005-0015692 | A | | 2/2005 | |
| KR | 10-2008-0056627 | | * | 6/2008 | ..... D06F 58/10 |
| WO | WO 97/01663 | A1 | | 1/1997 | |

* cited by examiner $d_2 < d < d_1$

WASHING MACHINE

This application is a continuation of U.S. patent application Ser. No. 12/753,584, filed Apr. 2, 2010, which claims priority from Korean Patent Application Nos. 10-2009-0029134, filed on Apr. 3, 2009, 10-2009-0029139, filed on Apr. 3, 2009, 10-2009-0099905, filed on Oct. 20, 2009, 10-2009-0109908, filed on Nov. 13, 2009, and 10-2010-0006144, filed on Jan. 22, 2010, the disclosures of which are incorporated herein by reference in their entireties.

BACKGROUND OF THE INVENTION

1. Field of the Invention

The present invention relates to a washing machine and, more particularly, to a washing machine capable of simultaneously spraying washing water to a side wall and bottom of a washing tub to effectively rinse the laundry.

2. Description of the Related Art

A washing machine generally refers to various devices for processing the laundry by applying a physical and chemical action to the laundry, such as a laundry machine for detaching a contaminant from the clothes, bedclothes, and the like, (referred to as the 'laundry', hereinafter) by using a chemical decomposition operation between water and a detergent and a physical operation such as friction between water and the laundry, a dryer for spin-drying the wet laundry; and a refresher for spraying (or spraying) heated stem to the laundry to prevent an allergy due to the laundry, and simply washing the laundry.

The washing machine is divided into an agitator type washing machine, a drum type washing machine, and a pulsator type washing machine depending on their structure and washing method. The washing machine washes the laundry by sequentially performing a washing course, a rinsing course, and a spin-drying course. In this case, only a certain course, among the courses, may be performed according to a user selection, and the laundry may be washed according to a proper washing method based on the type of the laundry.

However, the related art washing machine performs washing such that washing water is supplied toward the bottom of a washing tub and, as the supplied washing water fills the washing tub, the laundry is wet. Thus, in order to wet all the laundry, water must be supplied as high the laundry, causing a problem in that an excessive amount of washing water is consumed. In particular, recently, in the washing machine, the washing tub rotates at a high speed to perform spin-drying in the course of the washing process, and wash is supplied to rinse the laundry after spin-drying. At this time, the laundry cling to the side wall of the washing tube due to the high speed rotation of the washing tub, and in order to rinse the clinging laundry, washing water must be supplied as high as the position whether the laundry cling, resulting in consumption of an excessive amount of washing water. In particular, because the process is intermittently repeated during the washing process, further increasing the amount of consumed washing water.

SUMMARY OF THE INVENTION

According to an aspect of the present invention, there is provided a washing machine including: a cabinet forming an external appearance and having an open upper portion; a reservoir hanging within the cabinet and allowing washing water to be put therein; a washing tub rotatably disposed within the reservoir and accommodating the laundry; and a spray nozzle spraying washing water into the washing tub such that one boundary of sprayed washing water reaches a side wall of the washing tub and the other boundary of the sprayed washing water reaches the bottom of the washing tub, wherein the spray nozzle includes: a tube part forming a passage along which washing water is introduced; and a spray part connected with the tube part to spray washing water and disposed such that a spray face against which washing water discharged from the tube part splashes is bent at a certain angle with respect to a discharge direction of the tube part.

In the washing machine according to an exemplary embodiment of the present invention, because washing water is simultaneously sprayed to the side wall and bottom of the washing tub, the laundry can be effectively wet and the washing performance and rinsing performance can be improved.

Also, In the washing machine according to an exemplary embodiment of the present invention, because washing water is directly sprayed to the laundry clinging to the side wall of the washing tub, the amount of consumed washing water can be reduced.

In addition, in the washing machine according to an exemplary embodiment of the present invention, washing water can be sprayed to a larger area.

Moreover, because the washing machine according to an exemplary embodiment of the present invention includes the spray nozzle for spraying washing water to the bottom surface and the side wall of the washing tub and is formed such that the section of a flow path increases toward the side wall of the washing tub, a spray range with respect to the side wall of the washing tub can be increased, so the clothes or laundry can be easily wet.

Furthermore, in the washing machine according to an exemplary embodiment of the present invention, because the spray nozzle has flat upper, lower, left and right faces without a bent, washing water can be sprayed to be straightly stretched out. Because washing water is straightly sprayed, a spray speed can be improved and a spray range can be secured.

Also, because the washing machine according to an exemplary embodiment of the present invention includes the spray nozzle for spraying water to the interior of the washing tub, when a load of the washing tub is a minimum load, the spray nozzle sprays water at a height at which the spray nozzle can spray water to the side wall, whereby both the side wall spray and the bottom spray can be performed. Also, when the load of the washing tub is a maximum load, the spray nozzle sprays water to below a pre-set uppermost allowance spray point, thus preventing the occurrence of a phenomenon that sprayed water from flowing out of the washing tub. Thus, the side wall spray and bottom spray of the washing tub can be performed always regardless of the change in the height of the washing tub according to the load of the washing tub. Because the laundry can be effectively wet, the washing and rinsing performance can be improved.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
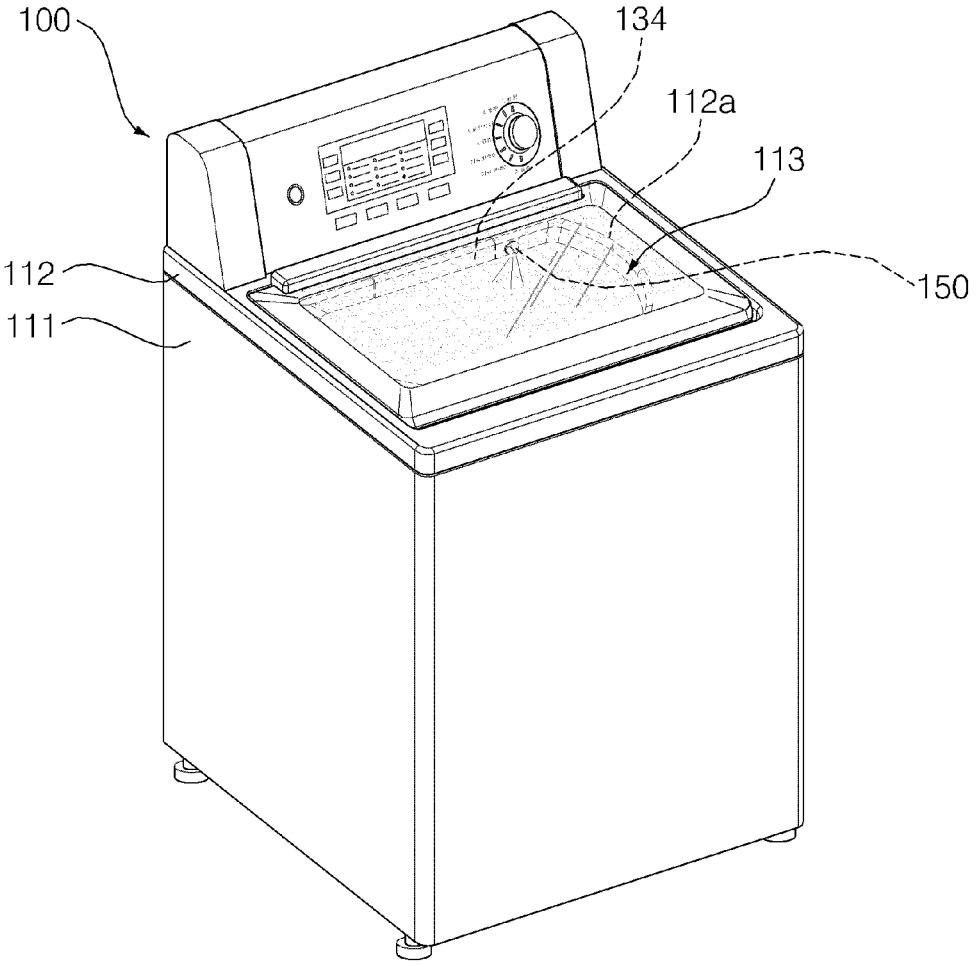
FIG. 1 is a perspective view of a washing machine according to an exemplary embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Figure 2:
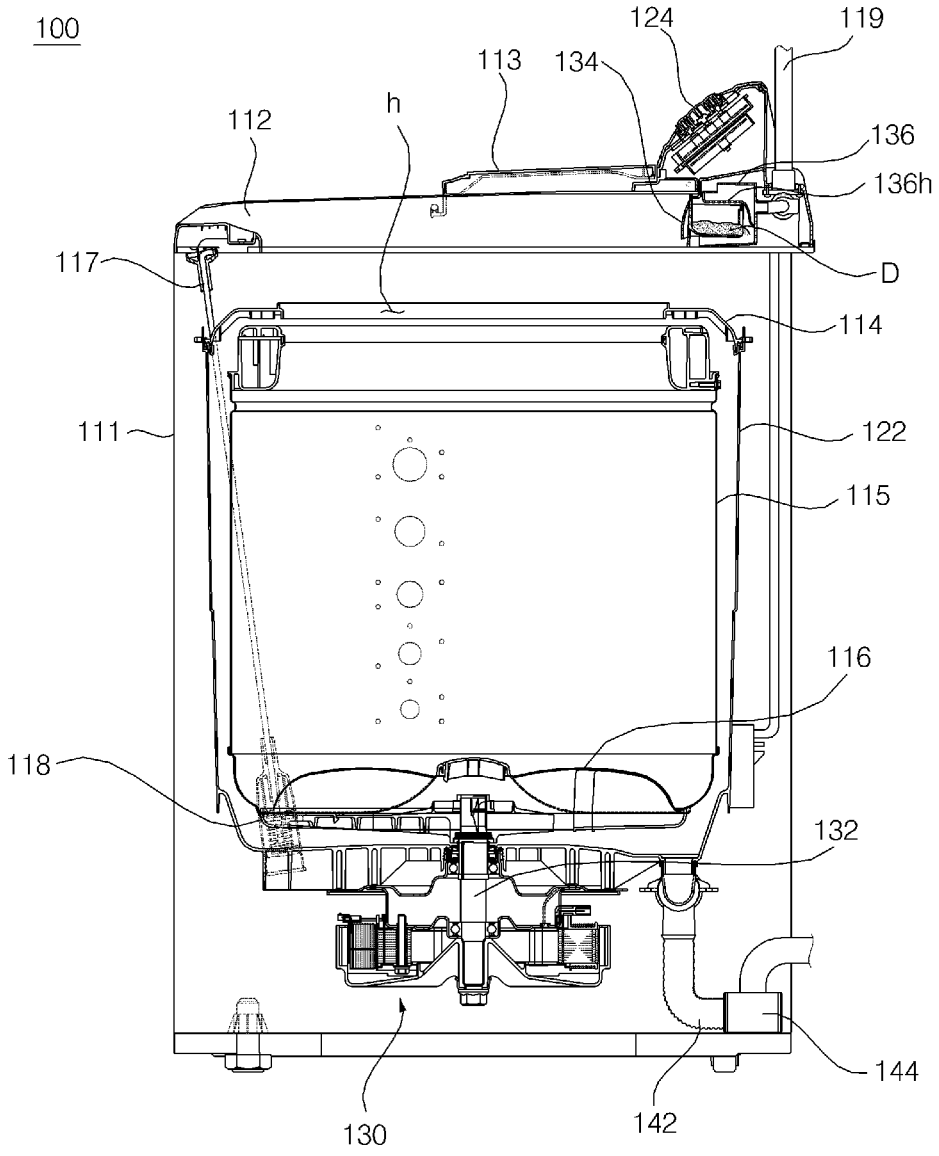
FIG. 2 is a side sectional view of the washing machine illustrated in FIG. 1 according to an exemplary embodiment of the present invention.
Figure 3:
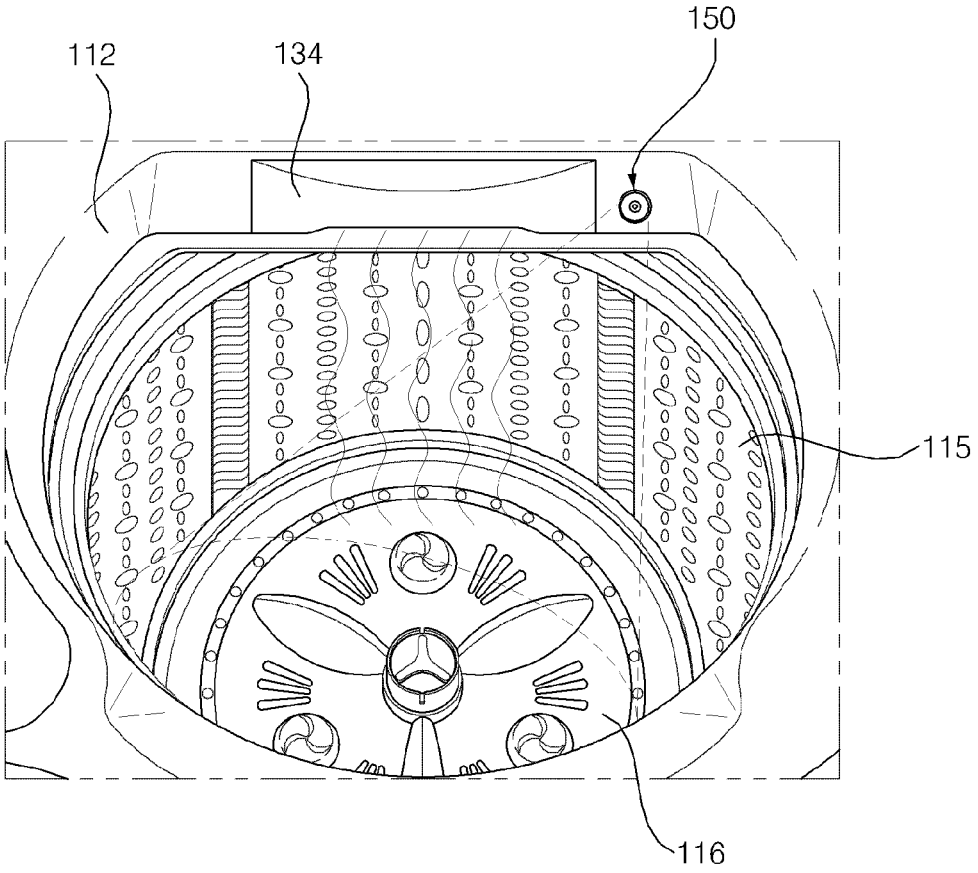
FIG. 3 is a partial enlarged view showing a portion of a laundry entry hole of the washing machine illustrated in FIG. 1 according to an exemplary embodiment of the present invention.
Figure 4:
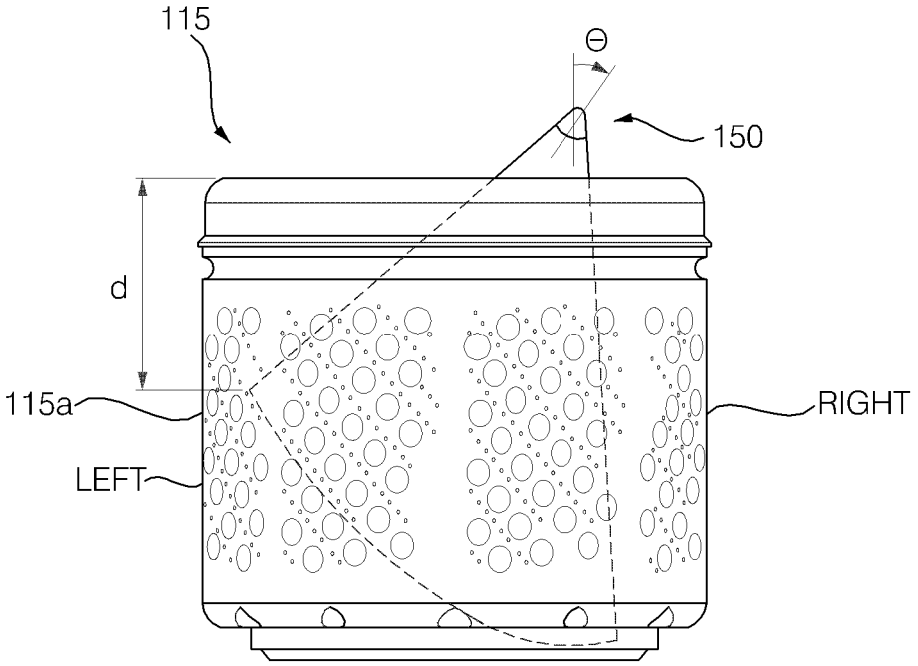
FIGS. 4 and 5 illustrate the form of washing water sprayed into the interior of the washing tub by a spray nozzle.
Figure 5:
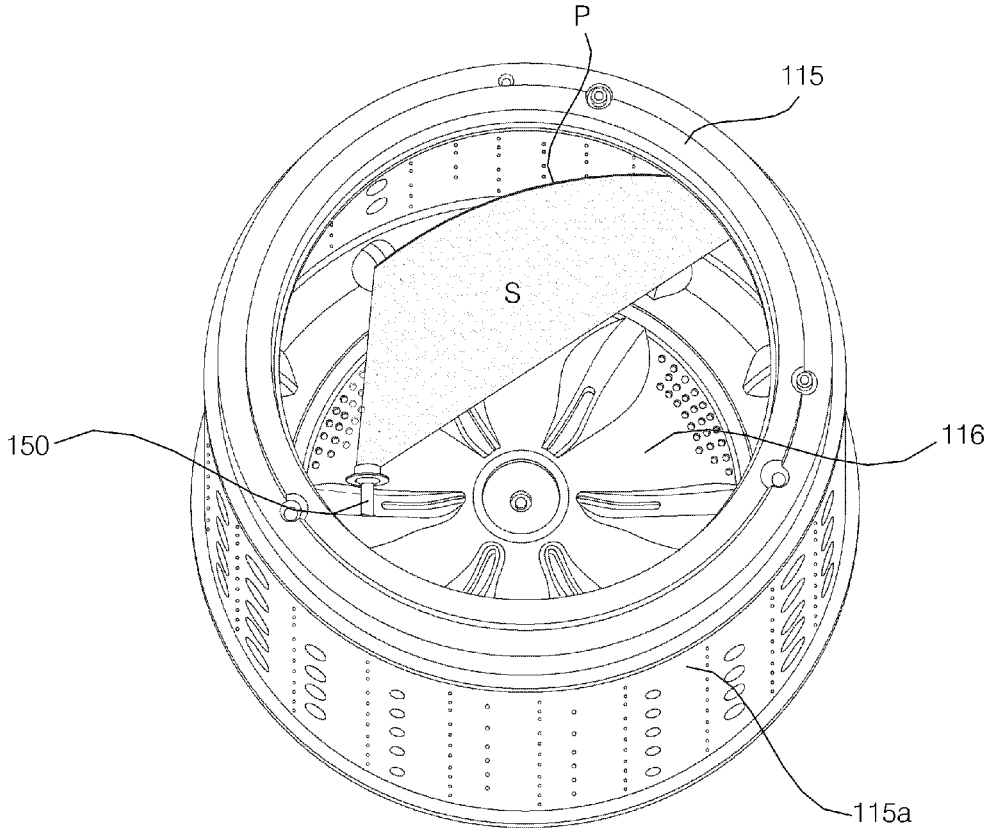
Figure 6:
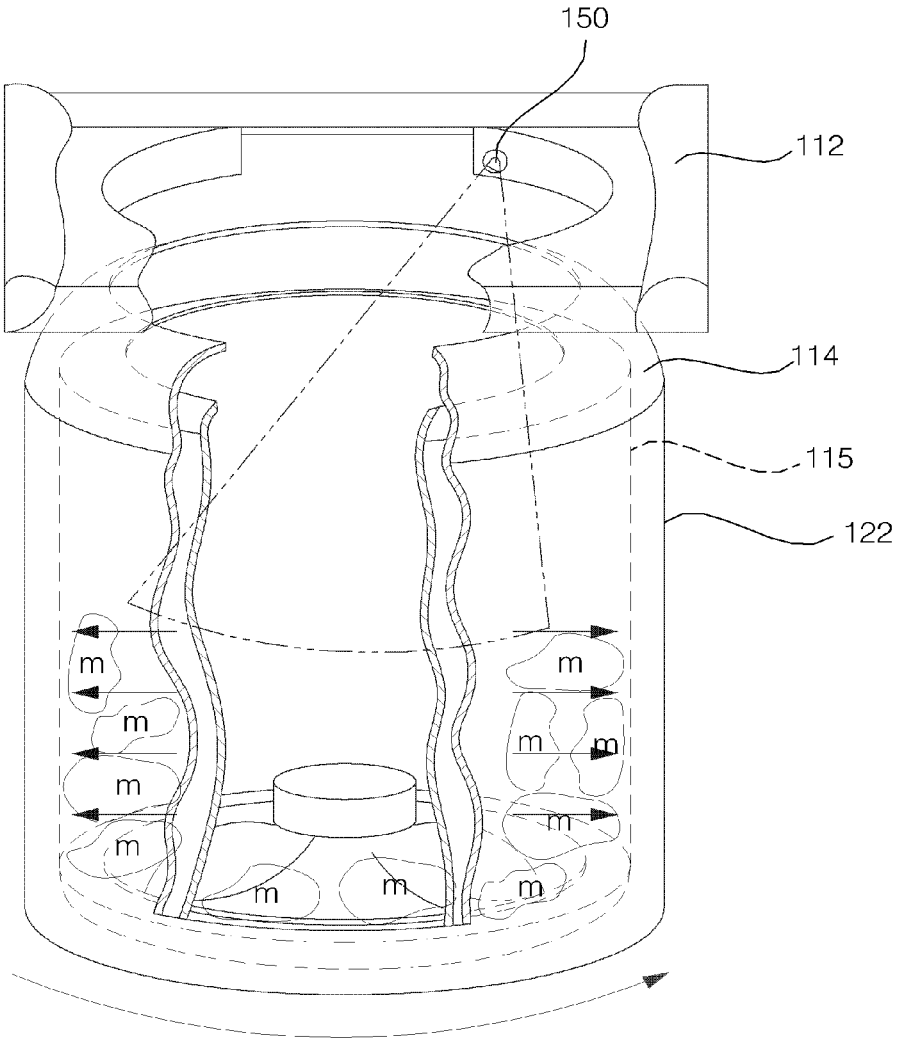
FIG. 6 is a partial view for explaining how the laundry is rinsed by the spray nozzle.
Figure 7:
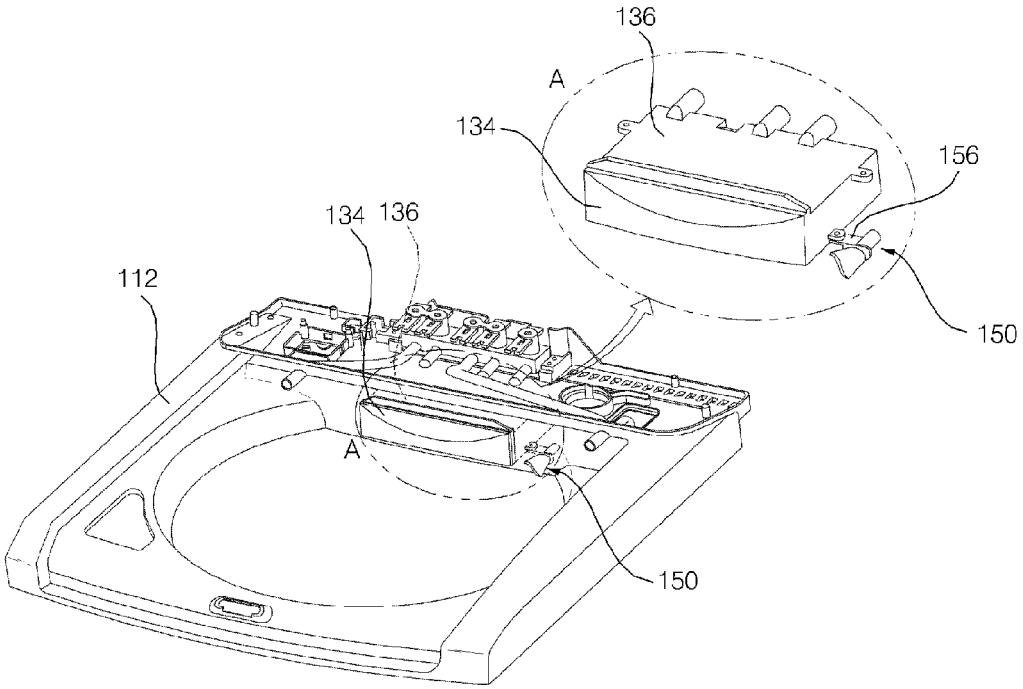
FIG. 7 illustrates mounting of the spray nozzle on a top cover.
Figure 8:
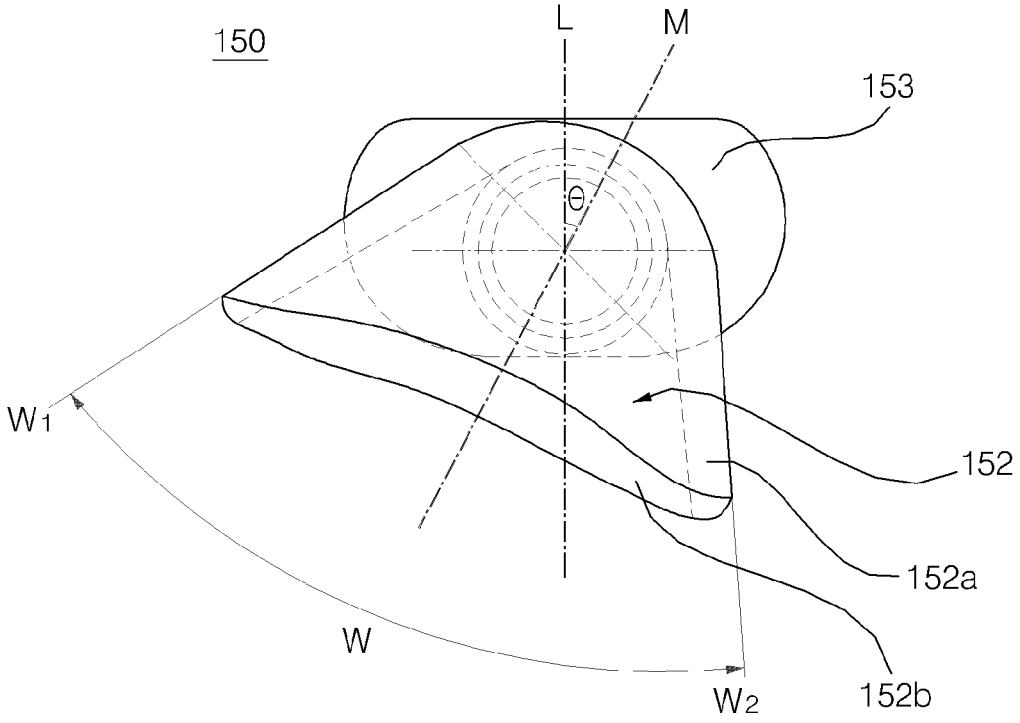
FIG. 8 illustrates a spray width angle and a rotation angle of the spray nozzle viewed from a front side.
Figure 9:
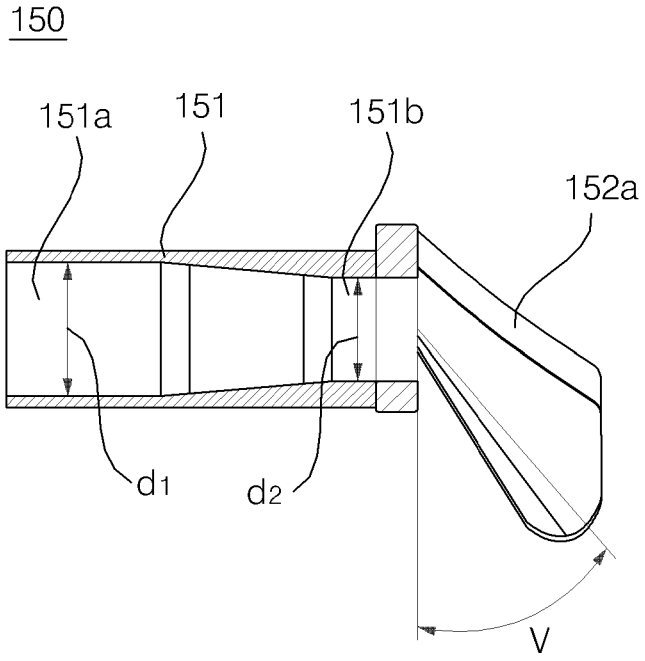
FIG. 9 illustrates a tilt angle of a cut-away spray nozzle.
Figure 10:
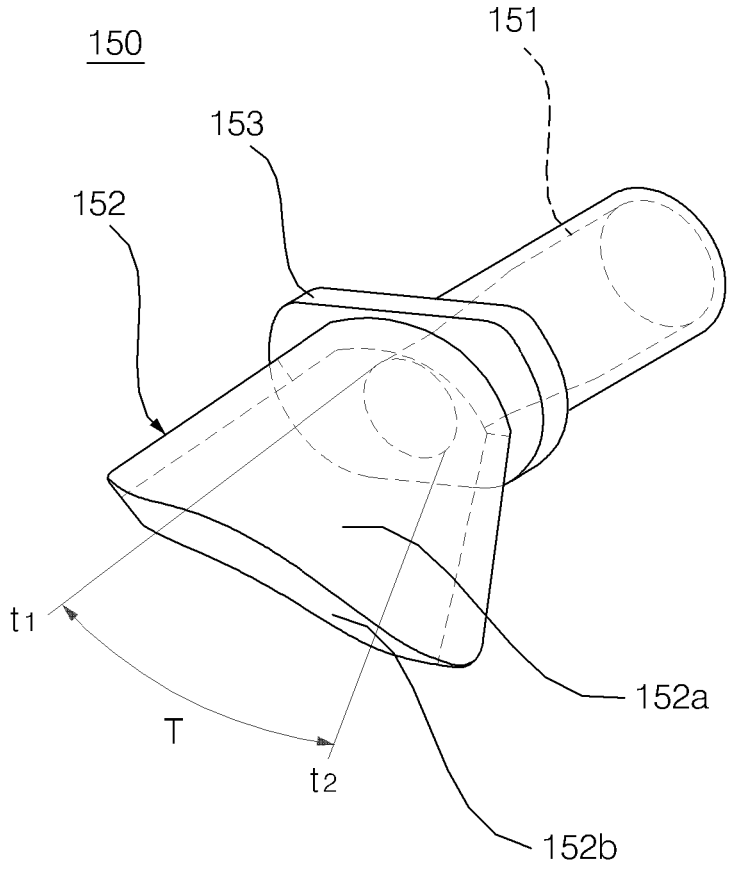
FIG. 10 is a perspective view of the spray nozzle.

FIG. 1 is a perspective view of a washing machine according to an exemplary embodiment of the present invention. FIG. 2 is a side sectional view of the washing machine illustrated in FIG. 1 according to an exemplary embodiment of the present invention. FIG. 3 is a partial enlarged view showing a portion of a laundry entry hole of the washing machine illustrated in FIG. 1 according to an exemplary embodiment of the present invention. FIGS. 4 and 5 illustrate the form of washing water sprayed into the interior of the washing tub by a spray nozzle. FIG. 6 is a partial view for explaining how the laundry is rinsed by the spray nozzle. FIG. 7 illustrates mounting of the spray nozzle on a top cover. FIG. 8 illustrates a spray width angle and a rotation angle of the spray nozzle viewed from a front side. FIG. 9 illustrates a tilt angle of a cut-away spray nozzle. FIG. 10 is a perspective view of the spray nozzle. Exemplary embodiments of the present invention will now be described in detail with reference to FIGS. 1 to 10.

With reference to FIGS. 1 and 2, a washing machine 100 according to an exemplary embodiment of the present invention includes a cabinet 111 forming an external appearance and having an open upper portion, a top cover 112 disposed at the open upper portion of the cabinet 111 and having a laundry entry hole allowing the laundry (referred to as the 'clothes', hereinafter), a door 113 that opens and closes the laundry entry hole, a reservoir 122 hanging in the interior of the cabinet 111 by a support member 117, buffered by a suspension 118, and allowing washing water to put therein, and a washing tub 115 disposed in the interior of the reservoir 122, accommodating the clothes, and rotating based on a vertical shaft.

A plurality of water holes (not shown) are formed on the washing tub 115 to allow washing water to circulate between the reservoir 122 and the washing tub 115, and a reservoir cover 114 having a laundry entry hole (h) formed substantially on a central portion thereof to allow the clothes to enter therethrough is provided on an upper portion of the reservoir 122.

A pulsator 116 forming a rotatory water current is provided on the bottom of the washing tub 115, and a motor 130 is disposed at a lower side of the reservoir 122 to provide rotatory power to rotate the washing tub 115 and/or the pulsator 116. A drain hose 142 and a drain pump 144 are provided to drain washing water from the reservoir 122.

A control panel 124 for receiving a user instruction with respect to general operation of the washing machine 100 and displaying an operational state of the washing machine 100 for user recognition is provided on the top cover 122.

A detergent water supply unit is provided at the top cover 112. The detergent water supply unit includes a detergent box 134 accommodating a detergent (D) and a detergent box housing 136, in which the detergent box 134 is received such that it can be drawn out, forming a flow path along which washing water introduced from a water supply hose 119 connected with an external water source such as a faucet or the like to be supplied to the interior of the washing tub 115 by way of the detergent box 134. The detergent box housing 136 may include a distribution hole **136*h* to allow washing water introduced from the water supply hose 119 to be distributed therethrough to the detergent box 134**.

Also, the washing machine 100 includes a spray nozzle 150 for spraying washing water to the interior of the washing tub 115. Various types of flow paths may be configured to guide washing water which has been introduced through the water supply hose 119 to the spray nozzle 150. For example, a proper flow path allowing washing water by way of the detergent box 134 to be guided to the spray nozzle 150 may be configured to inject detergent water through the spray nozzle 150. Alternatively, a flow path allowing washing water which has been introduced through the water supply hose 119 to be sprayed directly through the spray nozzle 150, without going through the detergent box 134, may be configured.

When the user sets a washing course, a washing time, and the like, through the control panel 124 and the washing machine starts to operate, a detergent must be supplied to wash the clothes. To this end, washing water containing a detergent (referred to as 'detergent water') obtained as the washing water goes through the detergent box 114 is supplied.

In this case, the washing water may be sprayed to the interior of the washing tub 115 through the spray nozzle 150. The washing water sprayed by the spray nozzle 150 directly reaches the clothes in a spreading manner, so the amount of washing water required for wetting the clothes and the time required for wetting the clothes can be reduced.

With reference to FIGS. 4 and 5, the spray nozzle 150 sprays washing water substantially in a downward directly. Then, the washing water simultaneously reaches the bottom and a side wall of the washing tub 115.

The spray nozzle 150 is coupled to the top cover 112 in a rotated state at a certain angle (θ) with respect to a vertical line, so that a spray direction of washing water can be lopsided to one of a left portion and a right portion of the washing tub 115.

In the present exemplary embodiment, the spray nozzle 150 is disposed at the right side based on the washing tub 115 when viewed at a front side, so a spray direction is rotated substantially to point to the left side to sufficiently spray washing water to the left side of the washing tub 115.

Because the spray nozzle 150 is provided on the top cover 112 in a rotated state at a certain angle, washing water sprayed by the spray nozzle 150 reaches the side wall and the bottom of the washing tub 115. In this case, the boundary (P) of the region where washing water sprayed by the spray nozzle 150 reaches the washing tub 115 is formed making a slant line from the side wall to the bottom of the washing tub 115, thus having an effect of enlarging the spray area.

With reference to FIG. 6, spin-drying may be performed to remove the detergent of the clothes (m) during the operation of the washing machine 100. For example, spin-drying may be performed intermittently during the washing course. Such intermediate spin-drying may be performed on the clothes by rotating the washing tub 115 at a high speed. When the intermediate spin-drying is performed the clothes (m) cling to the side wall of the washing tub 115 due to the centrifugal force generated as the washing tub 115 is rotated at a high speed.

Referring to the related art washing machine in which washing water is supplied toward the bottom of the washing tub and the clothes are wet as the supplied washing water fills the washing tub, a problem may arise in that a large amount of washing water is required to rinse the clothes clinging to the side wall of the washing tub and washing water contaminated while being used for rinsing the clothes remains on the washing tub to contaminate the clothes. Thus, the process of draining contaminated washing water in the washing tub and supplying clean washing water must be repeatedly performed several times, further increasing the amount of consumed washing water.

Thus, in order to solve the problem, the washing machine 100 according to an exemplary embodiment of the present invention sprays washing water toward the side wall and the bottom of the washing tub 115 so that washing water can directly reach the clothes (m) present on the side wall and the bottom of the washing tub 115. In this case, preferably, the washing tub 115 rotates to allow washing water to be evenly sprayed to the clothes. The washing tub 115 may be continuously rotated in one direction, or may be rotated in both directions alternately.

Contaminated washing water after rinsing the clothes is drained to the reservoir 122 through the water holes formed on the washing tub 115 by the centrifugal force, and then drained out through a drain flow path 142 as a drain pump 144 operates. Thus, re-contamination of the clothes can be prevented.

With reference to FIG. 7, the spray nozzle 150 may be disposed in the vicinity of one side of the detergent water supply units 134 and 136 provided on the top cover 112. To this end, a bracket 156 may be installed to the detergent box housing 136 to fix the spray nozzle 150.

With reference to FIGS. 5 and 8 to 10, the spray nozzle 150 includes a tube part 151 forming a passage to which washing water is introduced and an spary part 152 which guides a proceeding direction of washing water discharged from the tube part 151 to a lower side slantingly and has a flow path sectional area gradually increasing to allow washing water which has passed through the tube part 151 to be distributed (or dispersed).

The spray part 152 may have a funnel-like shape so that the flow path sectional area increases toward an outlet from which washing water is sprayed toward the washing tub 115 from an inlet to which washing water is introduced through the tube part 151.

The spray part 152 includes a spray face **152*a* against which washing water discharged from the tube part 151 splashes to be sprayed. The spray face 152*a* is disposed to be bent at a certain angle from the tube part 151**.

The spray face **152*a* is formed such that its width increases toward the outlet from which washing water is sprayed. Thus, washing water discharged to the spray face 152*a* from the tube part 151 spreads thinly along the spray face 152*a* so as to be sprayed while forming a face (S), and the angle between both boundaries of the sprayed washing water is determined by the both ends of the spray face 152*a***.

Meanwhile, because the spray face **152*a* is disposed to be bent at a certain angle from the tube part 151, washing water is lopsidedly sprayed to one of the left right and right side, and the boundary (P) formed as the sprayed washing water meets the washing tub 115 makes a slant line from the side wall to the bottom of the washing tub 115**.

The structure in which the spray face **152*a*** is bent will be described in detail later.

The spray nozzle 150 may include a reinforcing part 153 for reinforcing a coupling strength when the spray nozzle 150 is mounted on the top cover 112. The reinforcing part 153 may be formed as a plate body formed to be protruded along the circumference of the tube part 151. With reference to FIG. 8, the reinforcing part 153 is formed as a plate body which is lengthy in a widthwise direction.

The spray part 152 is formed to be symmetrical based on a reference line (M), and as shown in FIG. 8, when it is viewed from a front side, the spray nozzle 150 is aligned in a rotated state at a certain angle (θ) between the reference line (M) and a vertical line (L) based on a central line penetrating the tube part 151 in a lengthwise direction as an axis.

The angle (θ) will be defined as a 'rotation angle', hereinafter. Because the spray nozzle 150 is aligned in the rotated state at the angle (θ) from the vertical line (L), as shown in FIG. 8, washing water, which is to reach the washing tub 115, proceeds from the side wall of the washing tub 115 in a slant line direction to reach the bottom, making the boundary (P).

The boundary (P) is formed as the washing water sprayed while making the face (S) to reach the inner surface of the washing tub 115.

Meanwhile, the spray face 152*a* of the spray part 152 makes a certain angle (V) with the vertical line (L). Hereinafter, the certain angle (V) will be defined as a 'tilt angle'. Namely, as the tilt angle (V) is smaller, washing water will be sprayed more downward. Also, as the tile angle (V) is smaller, the impact applied to washing water, discharged from the tube part 151, from the spray face 152*a* increases, so the washing water will spread to be sprayed.

Meanwhile, the width of the washing water sprayed by the spray nozzle 150 is determined at the angle (W in FIG. 8) formed by the both boundaries W1 and W2 making the width of the flow path formed by the inner surface of the spray part 152. Hereinafter, the angle W will be defined as an 'spray width angle'. The spray width angle may be determined by the both side ends of the spray face 152*a* against which washing water splashes.

The tube part 151 is formed such that its inner diameter decreases toward an outlet 151*b* from which washing water is discharged from an inlet 151*a* to which washing water is introduced. With reference to FIG. 9, the inlet 151*a* has an inner diameter d1, and the outlet 151*b* has an inner diameter d2, and in this case, d1 is larger than d2. Namely, the diameter of the tube part 151 diminishes toward the outlet 151*b* from the inlet 151*a*, a movement speed of washing water introduced into the spray part 152 can be increased and a spray force can be strengthened.

As for a flow amount of washing water introduced to the tube part 151, washing water guided through the tube part 151 may be sprayed along the spray face 152*a* and a lower face 152*b* forming a lower portion of the spray part 152 at a certain angle with the spray face 152*a*, and in this case, a spray thickness of washing water may be determined by an angle (T) between the spray face 152*a* and the lower face 152*b*.

In the washing machine 100 according to an exemplary embodiment of the present invention, washing water is sprayed to the side wall and the bottom of the washing tub 115, and in this case, the rotation angle (θ), the spray width angle (W), and the tilt angle (V) are determined such that the boundary formed as the sprayed washing water meets the washing tub 115 makes a slant line. 'W' can makes an obtuse angle, and 'V' and 'θ' make an acute angle.

Due to the characteristics of the spray nozzle 150 disposed to have the tilt angle (V) and the rotation angle (θ), the spray face 152*a* is disposed to be bent from the tube part 151, and accordingly, washing water discharged from the tube part 151 splashes against the spray face 152*a*, refracted downward at the tilt angle (V), and is sprayed to the bottom of the washing tub 115, and also lopsidedly sprayed to one of the left side and the right side of the washing tub 115 at the rotation angle (θ) to reach the side wall of the washing tub 115.

In order to allow a larger amount of washing water, among washing water sprayed by the spray nozzle 150, to reach the side wall of the washing tub 115, the spray nozzle 150 may be rotated to increase the value (θ) so as to be mounted on the top cover 112, and in order to allow the washing water to be sprayed such that it is thinly spread in a widthwise direction, the value (T) may be increased while the value (V) may be reduced.

Figure 11:
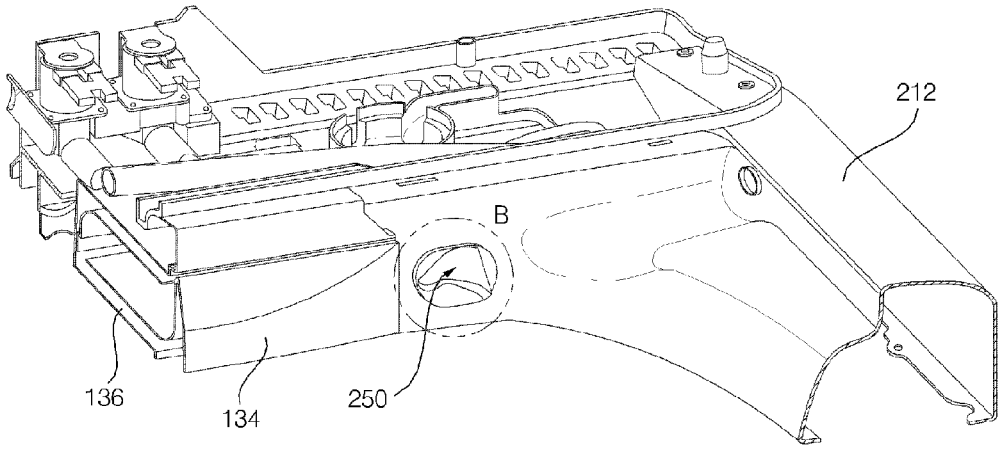
FIG. 11 is a partial perspective view showing coupling of the spray nozzle to a top cover according to another exemplary embodiment of the present invention.
Figure 12:
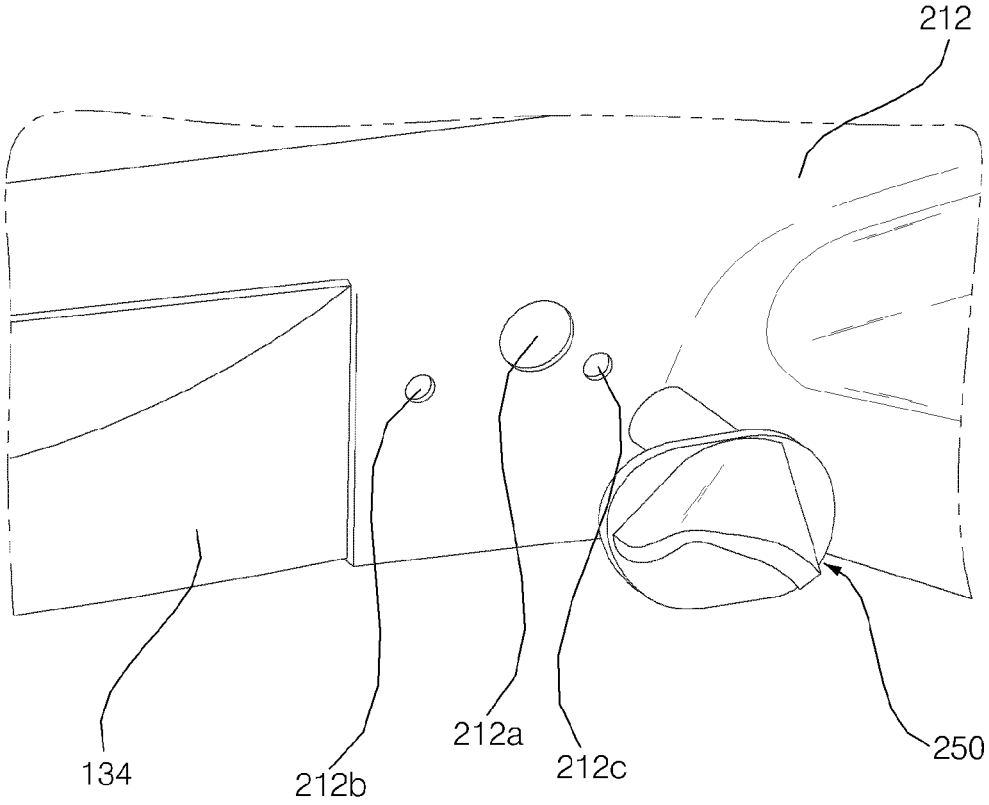
FIG. 12 illustrates assembling of the spray nozzle and the top cover illustrated in FIG. 11.
Figure 13:
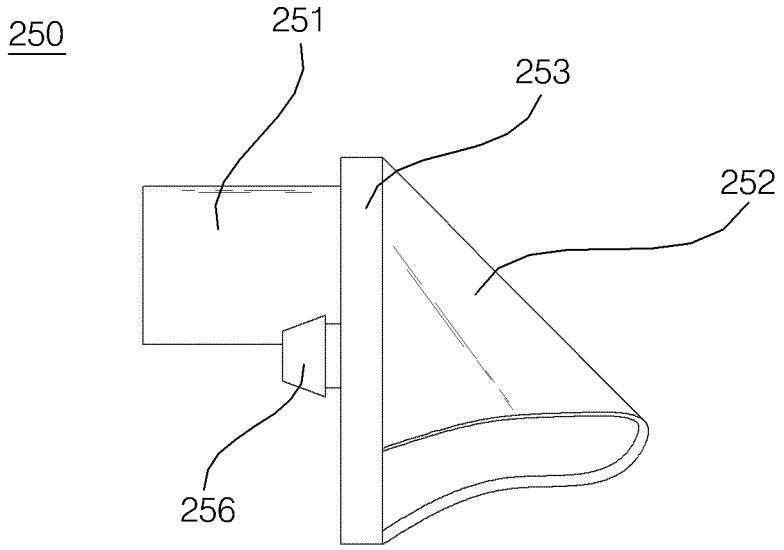
FIG. 13 is a side view of the spray nozzle illustrated in FIGS. 11 and 12.

FIG. 11 is a partial perspective view showing coupling of the spray nozzle to a top cover according to another exemplary embodiment of the present invention. FIG. 12 illustrates assembling of the spray nozzle and the top cover illustrated in FIG. 11. FIG. 13 is a side view of the spray nozzle illustrated in FIGS. 11 and 12.

A spray nozzle 250 according to the present exemplary embodiment may have a slightly different form from that of the spray nozzle 150 of the former exemplary embodiment but have the same structure in which washing water is sprayed to the side wall and the bottom of the washing tub 115. Thus, a description of the structure in which washing water is sprayed by the spray nozzle 250 and the form of the sprayed washing water will be omitted.

A tube part through hole 212*a* and spray nozzle position configuration holes 212*b* and 212*c* are formed on the top cover 212 to install the spray nozzle 250. A tube part 251 of the spray nozzle 250 is inserted into the tube part through hole 212*a*, and position configuration protrusions 256 formed on the spray nozzle 250 is inserted into the position are inserted into the position configuration holes 212*b* and 212*c* to mount the spray nozzle 250 on the top cover 212. In this case, the disposition of the position configuration holes 212*b* and 212*c* are configured in consideration of a spray direction of the spray nozzle 250.

Figure 14:
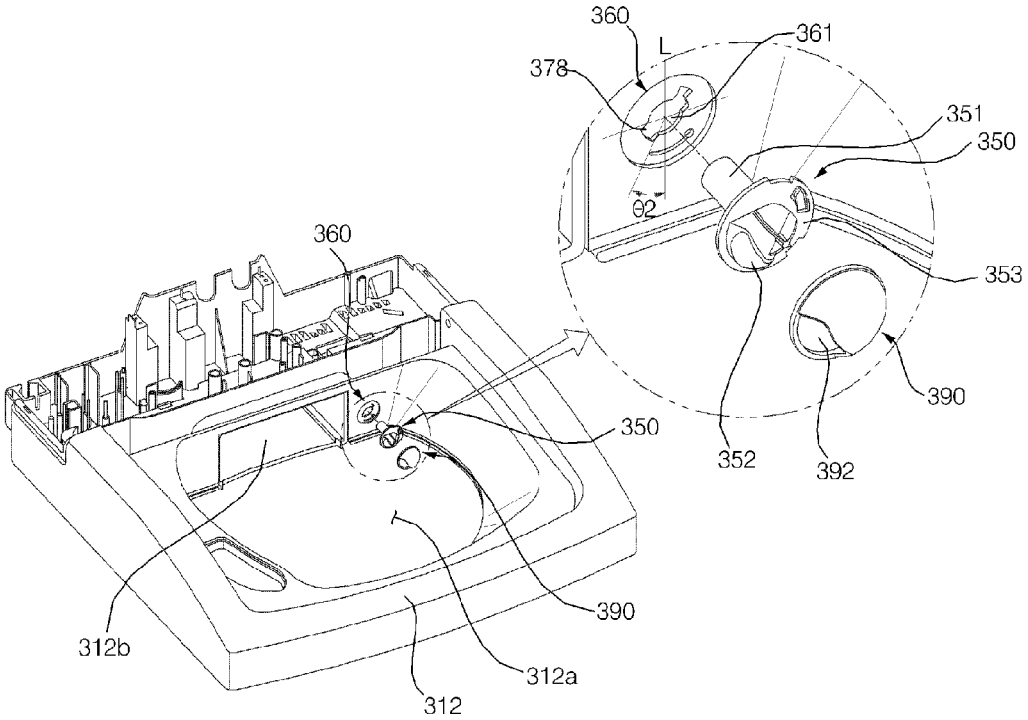
FIG. 14 is an exploded perspective view of coupling of a spray nozzle and the top cover according to still another exemplary embodiment of the present invention.

FIG. 14 is an exploded perspective view of coupling of a spray nozzle and a top cover according to still another exemplary embodiment of the present invention.

With reference to FIG. 14, a spray nozzle 350 according to still another exemplary embodiment of the present invention is coupled to a top cover 312, and a nozzle cap 390 is covered at an outer side of the spray nozzle 350.

A detergent box installation part 312*b* is formed to be open at one side, of the top cover 312, facing a laundry entry hole 312*a*. A detergent box housing (See 136 in FIG. 2) is installed on the detergent box installation part 312*b*, and a detergent box (See 134 in FIG. 2) is installed in the detergent box housing 136.

A spray nozzle coupling part 360 is formed on the top cover 312 in order to couple the spray nozzle 350.

The spray nozzle coupling part 360 may be formed at a position spaced apart in a lateral direction from the detergent box installation part 312*b*. However, without being limited thereto, the spray nozzle coupling part 360 may be formed at a different position, of the top cover 312, facing the laundry entry hole 312*a*

The spray nozzle 350 may be supplied with water from the water supply hose (See 119 in FIG. 2), and may be supplied with water through the detergent box. Here, it is assumed that the spray nozzle 350 is provided with water directly from the water supply hose 119.

Namely, the spray nozzle 350 is connected with a nozzle water supply hose (not shown) branched from the water supply hose 119 and sprays water which has passed through the water supply hose 119 and the nozzle water supply hose. A nozzle water supply valve (not shown) for controlling water supply to the spray nozzle 350 may be installed at the nozzle water supply hose.

However, without being limited thereto, the nozzle water supply hose connected with the spray nozzle 350 may be separately provided apart from the water supply hose 119, rather than being branched from the water supply hose 119.

The spray nozzle 350 includes a tube part 351 connected with the nozzle water supply hose (not shown) to guide water, a spray part 352 extended from the end of the tube part 351 to spray water, and a reinforcing part 353 extending in a radius direction between the tube part 351 and the spray part 352 to reinforce a coupling strength with the top cover 312.

The tube part 351 is inserted into the spray nozzle coupling part 360 of the top cover 312. The spray nozzle coupling part 360 includes a tube part insertion hole 361 formed at the center thereof to which the tube part 351 is inserted. The tube part insertion hole 361 is formed to correspond to the shape of the tube part 351.

Figure 15:
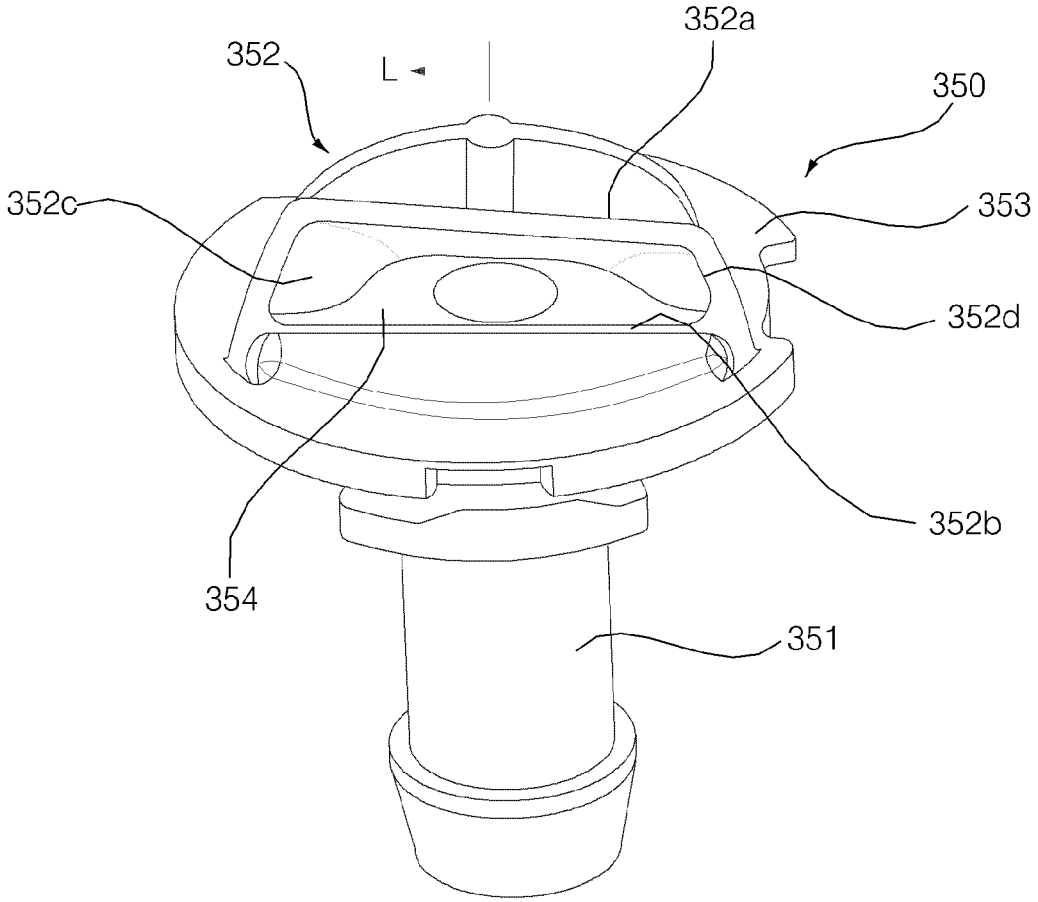
FIG. 15 is a perspective view of the spray nozzle illustrated in FIG. 14.
Figure 16:
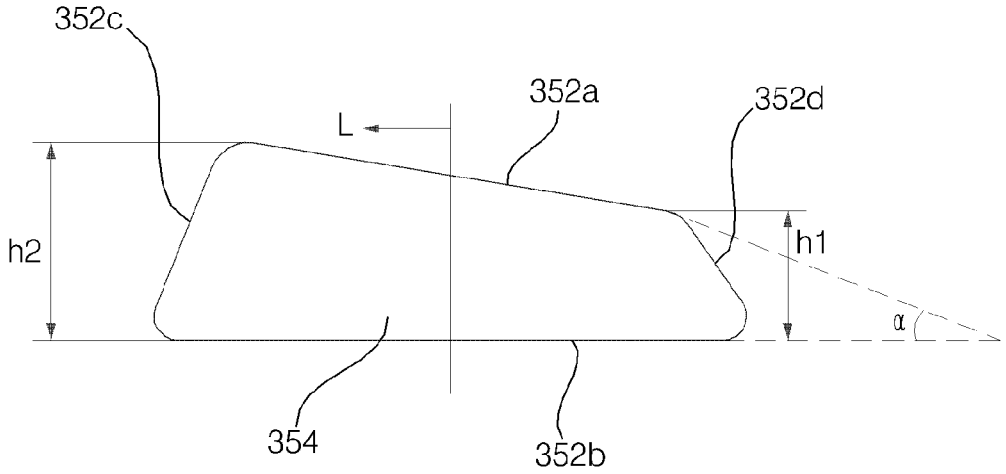
FIG. 16 illustrates a spray hole of FIG. 15.
Figure 17:
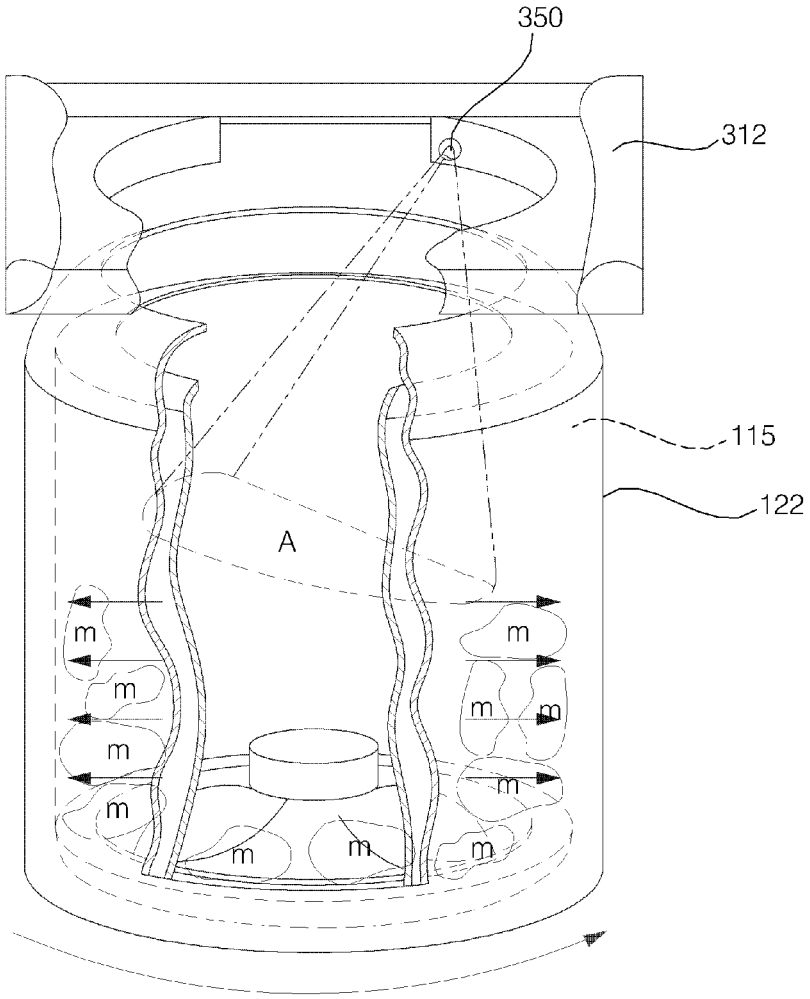
FIG. 17 is a perspective view for explaining the form of washing water sprayed into the interior of the washing tub by the spray nozzle illustrated in FIG. 15.

FIG. 15 is a perspective view of the spray nozzle illustrated in FIG. 14, FIG. 16 illustrates a spray hole of FIG. 15, and FIG. 17 is a perspective view for explaining the form of washing water sprayed into the interior of the washing tub by the spray nozzle illustrated in FIG. 15.

With reference to FIGS. 15 and 16, the spray part 352 includes an upper face portion 352*a* extending downward from an upper portion of the tube part 351, a lower face portion 352*b* extending downward from the lower side of the tube part 351 and facing the upper face portion 352*a*, and left and right face portions 352*c* and 352*d* connecting the upper face portion 352*a* and the lower face portion 352*b*.

The upper face portion 352*a* may limit an upward spray angle of water sprayed through the spray part 352, and the left and right face portions 352*c*, 352*d* may limit a horizontal directional spray angle of water sprayed through the spray part 352.

The upper face portion 352*a* is formed to slope downward from the tube part 351, and the upper face portion 352*a* and the lower face portion 352*b* have a shape of being apart in a vertical direction.

The maximum height the sprayed water is able to reach may vary, depending on the angle between the upper face portion 352*a* and lower face portion 352*b*.

The left face portion 352*e* is formed to slope in a leftward direction from the tube part 351, and the right face portion 352*d* is formed to slope in a rightward direction from the tube part 351. Namely, the left face portion 352*c* and the right face portion 352*d* may have a shape of being open in a horizontal direction.

The horizontal spray angle of water may vary depending on the angle between the left face portion 352*c* and the right face portion 352*d*.

Meanwhile, the spray part 352 may be formed such that its flow path sectional area gradually increases in the direction in which washing water is sprayed.

Also, the spray part 352 is formed such that its flow path increases gradually in the direction facing the left side wall of the washing tube 115, namely, in the leftward (L) direction. Namely, the spray part 352 may be formed not to be symmetrical based on the center of the tube part 351.

The spray part 352 is formed such that the distance between the upper face portion 352*a* and the lower face portion 352*b* increases gradually in the leftward direction (L).

In order to make the upper face portion 352*a* and the lower face portion 352*b* apart gradually in the leftward direction (L), both the upper face portion 352*a* and the lower face portion 352*b* may be formed to slope, or one of the upper face portion 352*a* and the lower face portion 352*b* may be formed to slope.

In the present exemplary embodiment, it is assumed that the upper face portion 352*a* of the spray part 352 is formed to slope at a certain angle ($\alpha$) based on the lower face portion 352*b*.

With reference to FIG. 16, because the upper face portion 352*a* of the spray part 352 is formed to slope at a certain angle ($\alpha$), a height (h2) at a left portion of a spray hole 354 is greater than a height (h1) at a right portion of the spray hole 354.

The upper face portion 352*a*, the lower face portion 352*b*, the left face portion 352*c*, and the right face portion 352*d* are formed to be flat without an irregular portion.

Because all the portions of the side wall of the spray part 352 are formed to be flat, washing water can be straightly sprayed. When the side wall of the spray part 352 has a curvature, water splashed against the side wall may gather, so in order to prevent this phenomenon, the upper face portion 352*a*, the lower face portion 352*b*, the left face portion 352*c*, and the right face portion 352*d* are formed to be flat without an irregular portion.

Regions where the upper face portion 352*a*, the lower face portion 352*b*, the left face portion 352*c*, and the right face portion 352*d* are formed to be flat with an irregular portion are in contact may be rounded at a certain angle.

With reference to FIG. 17, washing water sprayed from the spray part 352 sprays slopingly downward of the washing tub 115. When viewed from the front side of the washing machine, the spray nozzle 350 is disposed at the right side of the top cover 312, and because the spray nozzle 350 is coupled with the top cover 312 in a rotated state at a certain angle, the spray hole 354 faces the left side within the washing tub 115, washing water sprayed from the spray part 352 can reach both the side wall and the bottom of the washing tub 115.

In this case, likewise as described above with reference to FIG. 5, the upper boundary (P) of the region where washing water sprayed by the spray nozzle 350 reaches the washing tub 115 is formed making a slant line from the side wall to the bottom of the washing tub 115, thus having an effect of enlarging the spray area.

In the present exemplary embodiment, the spray nozzle 350 is disposed in a state of being rotated toward the left side wall of the washing tub 115 and the flow path sectional area of the spray part 352 increases gradually toward the leftward direction, the same direction in which the spray nozzle 350 rotates, the tilt of the upper boundary (P) of washing water sprayed from the spray part 352 may further increase. Also, the spray face (S in FIG. 5) of washing water can be enlarged.

Thus, because the tilt of the upper boundary (P) and the spray face(S) increase, a spray range of washing water sprayed through the spray part 352 can increase.

Also, the height of a maximum point for washing water sprayed from the spray part 352 to reach the washing tub 115 can heighten. Namely, the distance from the upper end of the washing tub 115 to the spray highest point can be reduced. Accordingly, a sufficient lateral spray can be secured to effectively wet the clothes.

With reference to FIG. 17, when the thickness of the spray face (S in FIG. 5) of washing water sprayed from the spray part 352 increases, the bottom surface of the washing tub 115 or a bottom spray area (A) in contact with the clothes can increase, effectively setting the clothes.

Figure 18:
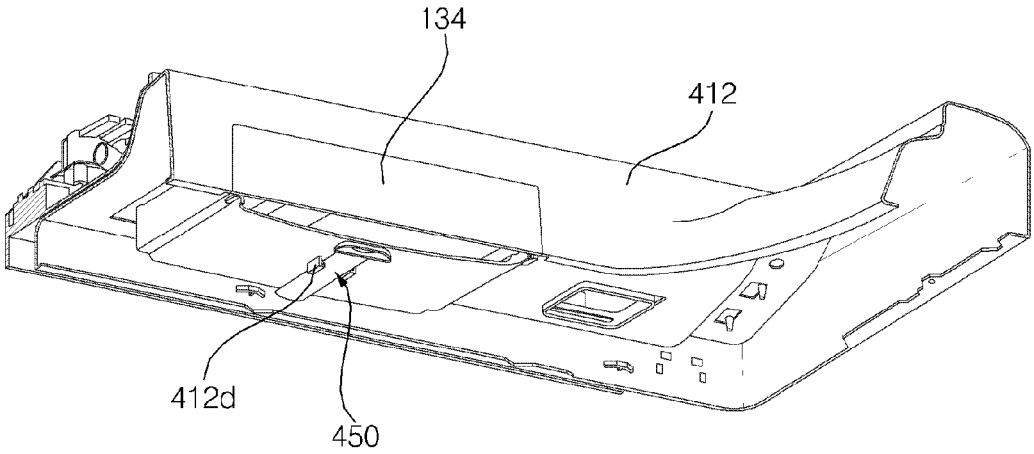
FIG. 18 illustrates disposing of a spray nozzle on the top cover in a different manner as those of the foregoing exemplary embodiments.
Figure 19:
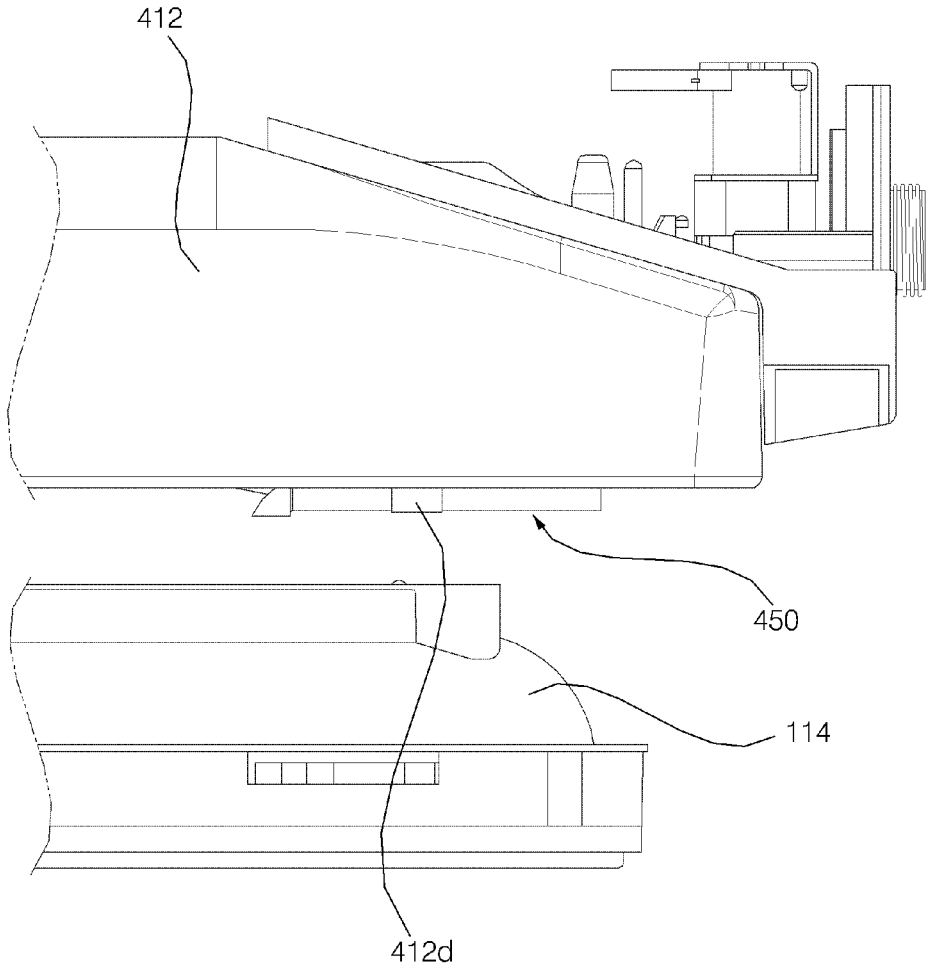
FIG. 19 is a side view of the top cover and the spray nozzle illustrated in FIG. 18.

FIG. 18 illustrates disposing of a spray nozzle on the top cover in a different manner as those of the foregoing exemplary embodiments. FIG. 19 is a side view of the top cover and the spray nozzle illustrated in FIG. 18.

A spray nozzle 450 according to the present exemplary embodiment may have a slightly different form from that of the spray nozzles 150, 250, and 350 of the former exemplary embodiments but have the same structure in which washing water is sprayed to the side wall and the bottom of the washing tub 115. Thus, a description of the structure in which washing water is sprayed by the spray nozzle 450 and the form of the sprayed washing water will be omitted.

With reference to FIGS. 18 to 19, the spray nozzle 450 is installed on a lower surface of a top cover 412 so as to be positioned at a lower side of the detergent box 134. A bracket 412*d* may be provided to install the spray nozzle 450 on the top cover 412.

With such a configuration, a portion of a flow path along which washing water is introduced to the detergent box 134 may be easily branched to be connected to the spray nozzle 450, and accordingly, the configuration of the flow path can be simplified.

Figure 20:
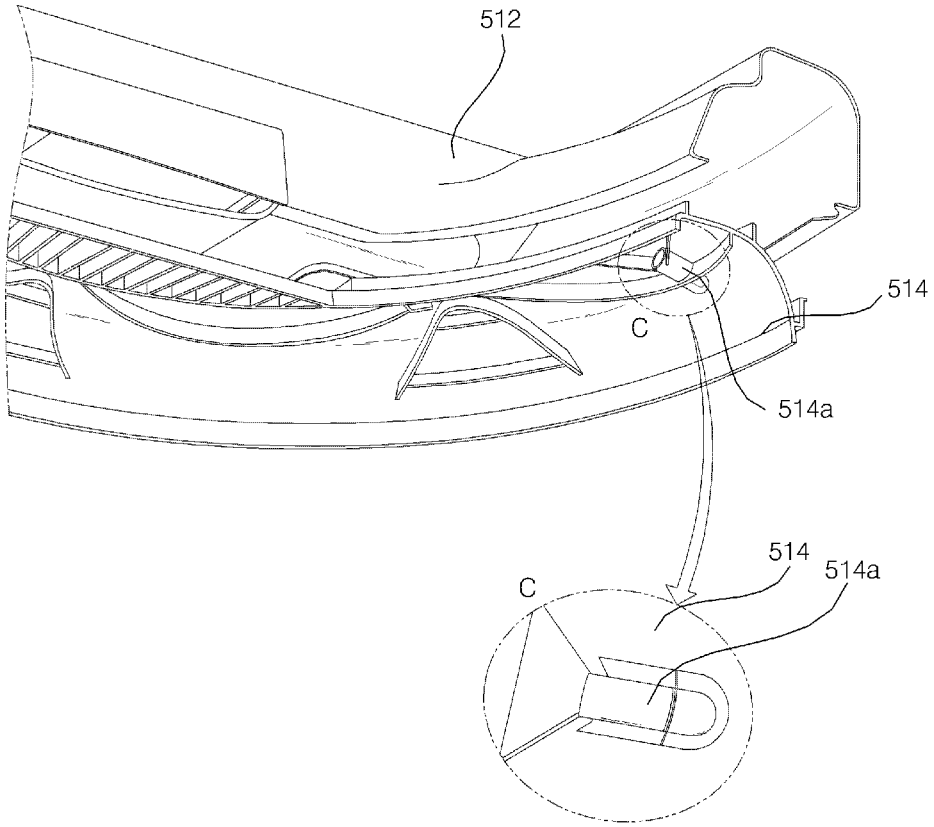
FIG. 20 is a bottom perspective view of a reservoir cover to explain disposing of a spray nozzle on the reservoir cover according to an exemplary embodiment of the present invention.
Figure 21:
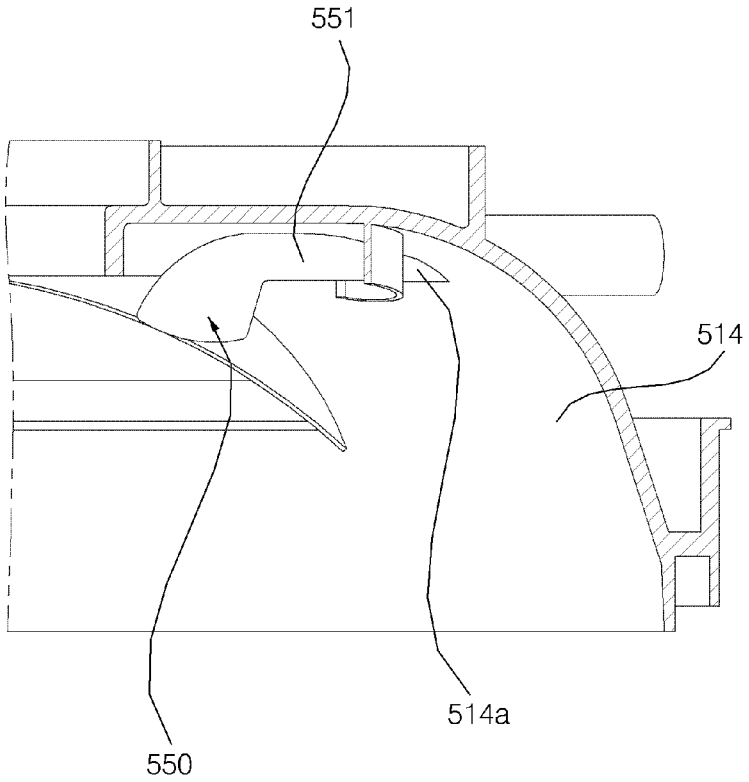
FIG. 21 is a side sectional view of the reservoir cover illustrated in FIG. 20.

FIG. 20 is a bottom perspective view of a reservoir cover to explain disposing of a spray nozzle on the reservoir cover according to an exemplary embodiment of the present invention. FIG. 21 is a side sectional view of the reservoir cover illustrated in FIG. 20.

A spray nozzle 550 according to the present exemplary embodiment may have a slightly different form from that of the spray nozzles 150, 250, 350, and 450 of the former exemplary embodiments but have the same structure in which washing water is sprayed to the side wall and the bottom of the washing tub 115. Thus, a description of the structure in which washing water is sprayed by the spray nozzle 450 and the form of the sprayed washing water will be omitted, The spray nozzle 550 may be provided on a lower surface of a reservoir cover 514. To this end, a tube part connection member 514*a* may be formed on a lower surface of the reservoir cover 514, into which a tube part 551 of the spray nozzle 550 is inserted, such that it is connected with an outer side of the reservoir cover 514.

Because the spray nozzle 550 is installed at the reservoir cover 514, although the height of the washing tub 115 varies according to the clothes and/or a load of washing water, the spray nozzle 550 can maintain a uniform height with respect to the washing tub 115. Thus, although the washing tub 115 sags downward because of an increased load, washing water can be stably sprayed into the washing tub 115, rather than overflowing the washing tub 115.

Figure 22:
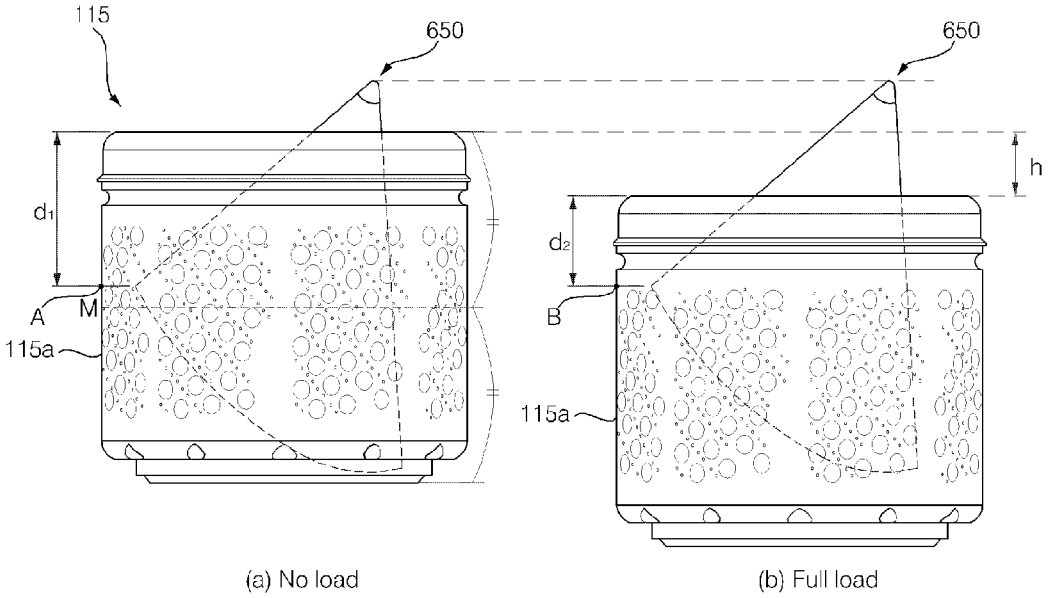
FIG. 22 illustrates a spray range of washing water sprayed from a spray nozzle.

FIG. 22 illustrates a spray range of washing water sprayed from a spray nozzle.

The spray nozzle 650 illustrated in FIG. 22 may be any one selected from among the spray nozzles 150, 250, 350, 450, and 550 in the above-described exemplary embodiments, because any one of the spray nozzles sprays washing water to the side wall and the bottom of the washing tub 115. Thus, it should be understood that the spray nozzle 650 described hereinbelow includes any type of spray nozzle that allow washing water sprayed therefrom to simultaneously reach the side wall and the bottom of the washing tub 115 according to the idea of the present invention.

The spray nozzle 650 according to the present exemplary embodiment is disposed to spray washing water at a height at which a lateral spray is available when the load of the washing tub 115 is a minimum load, and spray washing water below a pre-set uppermost allowance spray point when the load of the washing tub 115 is a maximum load.

Namely, when water is sprayed from the spray nozzle 650, the distance between the height point of water reaching the side wall 115*a* of the washing tub 115 and the upper end of the washing tub 115 is always within a certain range. This is to spray washing water by the spray nozzle 650 always into the washing tub 115 although the load to the washing tub 115 varies according to the amount of accommodated clothes and/or amount of washing water.

The spray range of the spray nozzle 650 may be adjusted according to an installation position of the spray nozzle 650 and a disposition angle of the spray nozzle 650. The disposition angle of the spray nozzle 650 is an angle at which the spray part of the spray nozzle 650 tilts toward the side wall 115*a* of the washing tub 115. For example, when the spray part 152 is disposed on the top cover 112 in a state that it is rotated by the angle θ based on the vertical line (L), a spray range of the spray nozzle 150 as shown in FIG. 8 can be adjusted by adjusting the angle θ.

In FIG. 22, (a) shows the case where the load of the washing tub 115 is a pre-set minimum load, and (b) shows the case where the washing tub 115 sags by a certain height (h) because the load of the washing tub 115 is a pre-set maximum load.

When the load of the washing tub 115 is the minimum load, the highest point (A) at which water sprayed from the spray nozzle 650 reaches the side wall 115*a* of the washing tub 115 is away by a distance d1 from the upper end of the washing tub 115. For example, d1 is 200 mm. The position of the highest point (A) is where the lateral spray is available. In order to make the lateral spray possible, the position of the highest point (A) must be higher than a middle point (M) of the side wall of the washing tub 115.

When the load of the washing tub 115 is a minimum load, the washing tub 115 may be set to be in a no-load state in which there is no laundry in the washing tub 115.

When the load of the washing tub 115 is a maximum load, a highest point (B) at which water sprayed from the spray nozzle 650 reaches the side wall 115*a* of the washing tub 115 is away by a distance d2 from the upper end of the washing tub 115. For example, d2 is 162 mm. The position of the highest point (B) must be a pre-set uppermost allowance spray point. The uppermost allowance spray point may be previously set according to experimentation or the like in order to prevent water splashed against the side wall 115*a*, after being sprayed from the spray nozzle 650 to the side wall 115*a* of the washing tub 115, from overflowing the washing tub 115. When the load of the washing tub 115 is a maximum load, the washing tub 115 sags downward, making the highest point (B) at which water sprayed from the spray nozzle 650 reaches the side wall 115*a* of the washing tub 115 is relatively high. Thus, in order to prevent water sprayed by the spray nozzle 650 from being dissipated to outside the washing tub 115, the position of the highest point (B) of water sprayed by the spray nozzle 650 needs to be limited. Namely, the position of the highest point (B) must be lower than the uppermost allowance spray point.

Thus, when the installation position and disposition angle of the spray nozzle 650 are set, it is preferred for the distance (d) between the highest point of water sprayed to the side wall 115*a* of the washing tub 115 from the spray nozzle 650 and the upper end of the washing tub 115 to be within d1 and d2 as the spray range of the spray nozzle 650.

When the spray range is set, although the load of the washing tub 115 is the minimum load, the lateral spray from the spray nozzle 650 can be performed. Also, although the load of the washing tub 115 is the maximum load, water sprayed from the spray nozzle 650 can be prevented from overflowing the upper end of the washing tub 115.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a cabinet having an open upper portion;

a detergent box to receive detergent;

a top cover disposed over the cabinet and having a laundry entry hole through which the laundry is loaded, the top cover including a front surface facing in a forward direction of the washing machine, on which an opening for receiving the detergent box, a tube part through hole spaced laterally apart from the opening, and a nozzle position configuration hole spaced apart from the tube part through hole are formed;

a hose supplying washing water, disposed in the cabinet;

a washing tub disposed in the cabinet to be rotatable about a vertical axis; and a spray nozzle disposed on the top cover, the spray nozzle having an outlet through which the washing water supplied from the hose is ejected, the outlet opened toward inside the washing tub, wherein the spray nozzle comprises:

a plate laterally disposed apart from the detergent box, the plate having a first surface facing the front surface of the top cover, disposed on the front surface of the top cover, and a second surface opposing to the first surface, the plate including a channel formed between the first and second surfaces;

a tube part perpendicularly extended from the first surface of the plate and coupled with the hose, the tube part being communicated with the channel, and inserted into the tube part through hole, wherein a position configuration protrusion is formed on the first surface of the plate and engaged with the nozzle position configuration hole to prevent the tube part from rotating about the tube part through hole; and a spray part on the second surface of the plate, spraying the washing water output from the channel inside the washing tub through the outlet, wherein the spray part comprises:

first and second lateral wall portions between which the washing water travels toward the outlet, the second lateral wall portion laterally disposed further apart from the detergent box than the first lateral wall portion; and a spray surface connecting the first and second lateral wall portions on opposite sides relative to the plate, the spray surface to which the washing water supplied through the tube part collides and allowing a traveling direction of the washing water to be refracted downward, the spray surface including an edge for the outlet, wherein the first lateral wall portion is elongated toward the outlet in a more upward direction than the second lateral wall portion.

2. The washing machine of claim 1, wherein the first and second lateral wall portions are disposed at both sides of an imaginary plane perpendicular to the second surface of the plate, respectively.

3. The washing machine of claim 2, wherein the first and second lateral wall portions are asymmetrically disposed about the imaginary plane.

4. The washing machine of claim 3, wherein the washing tub comprises a bottom and a cylindrical side wall upwardly extended from the bottom, wherein the first lateral wall portion is elongated toward the side wall, and wherein the second lateral wall portion is elongated toward the bottom.

* * * * *